US006419535B1

(12) United States Patent
Herrera

(10) Patent No.: US 6,419,535 B1
(45) Date of Patent: Jul. 16, 2002

(54) OUTBOARD ENGINE WITH ACOUSTIC SEALS INSTALLED IN MOTOR HOUSING OPENING

(75) Inventor: Eric Herrera, Burlington, WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/571,751

(22) Filed: May 15, 2000

(51) Int. Cl.[7] ..... B63H 20/32
(52) U.S. Cl. ..... 440/77; 181/204; 440/52
(58) Field of Search ..... 440/52, 76, 77; 181/204

(56) References Cited

U.S. PATENT DOCUMENTS 2,909,031 A * 10/1959 Kiekhaefer
3,195,530 A * 7/1965 Heidner
5,295,879 A * 3/1994 Meier et al.
6,056,611 A 5/2000 House et al. ..... 440/88

OTHER PUBLICATIONS

Polymer Technologies Inc. Product Data Sheets for Polydamp™ Acoustical Foam (1990), Polydamp™ Acoustical Barriers (1990) and Polydamp™ Extensional Dampung Pad (1989).

* cited by examiner

*Primary Examiner*—Sherman Basinger
(74) *Attorney, Agent, or Firm*—Dennis M. Flaherty

(57) ABSTRACT

The escape of acoustic energy via an opening in a motor housing penetrated by a steering arm is reduced by installing a pair of acoustic seals. The seals have respective membranes which extend across respective portions of the opening in the housing. These membranes are flexible, self-supporting and substantially block the transmission therethrough of acoustic wave energy in the range of 1,000 to 3,000 hertz. The acoustic seals installed in the housing opening, in combination with a vibro-acoustic treatment applied on the inner surface of the motor housing, suppress noise produced by the motor.

26 Claims, 9 Drawing Sheets

OUTBOARD ENGINE WITH ACOUSTIC SEALS INSTALLED IN MOTOR HOUSING OPENING

FIELD OF THE INVENTION

This invention relates to seals for blocking the escape of acoustic wave energy, e.g., engine noise, from an enclosure via an opening. In particular, the invention relates to acoustic seals installed in a gap in a vibro-acoustic treatment applied to an enclosure having an opening.

BACKGROUND OF THE INVENTION

Typical marine engines are noisy, especially when being operated at higher rpm's while driving a vessel rapidly through the water. This noisy operation is extremely unattractive to occupants of the vessel, as well as to passers-by, and it is highly desirable to reduce this noise without reducing vessel efficiency. Further, regulatory bodies, in their desire to improve the environment, are imposing emission standards on marine vessels. These standards not only regulate the contents of the emissions but also apply to the noise level of the emission. It is therefore highly desirable to provide a marine engine that is noise reduction efficient without detracting from the vessel operating efficiently.

More general than the noise reduction is noise control. Noise control requires an understanding of the vibro-acoustic behavior of the article in question with its environment. If boundary conditions permit, approximations can be made by isolating the article from its environment. This cannot be done "simply" for an integrated structure. For example, an outboard marine engine is an integrated structure. To capture correctly the vibro-acoustic behavior of an outboard engine, the engine should be fully assembled, mounted to a boat and in the open water. For example, feedback from the added inertia of the water as the boat travels in the water could produce a narrow-band spectrum different from a steady-state condition. There is also feedback from the components of the engine, for example, the crankshaft and block can produce a phenomenon that does not exist for either part acting alone.

To determine the acoustic "fingerprint" for an integrated structure such as an outboard marine engine, a narrow-band analysis must be performed. This will allow identification of tones, i.e., frequency responses, of the interacting components. The components corresponding to these responses can be identified from the frequencies, i.e., based on wavelength and speed of sound. Vibro-acoustic treatments can be designed and or critically placed to attenuate or simply move a tone from one frequency to another. The effectiveness of this effort is based on the precision of the data and the methodology by which the data is acquired.

The precision of the data is a function of the frequencies of the data collected and of the transducer sensitivity. The frequency range of interest is a function of human hearing, i.e., 10 kHz is sufficient. For the present work, data was collected using accelerometers and microphones. Accelerometer data was collected to 5 kHz at 1 Hz bandwidth; microphone data was collected to 10 kHz at 2.5 Hz bandwidth. Acoustic intensity testing and stethoscopic probing both showed agreement that over 80% of the vibro-acoustic energy produced by a particular outboard marine engine was coming from below the interface between the engine's upper and lower motor covers.

To suppress noise emitted by a motor encased in a motor housing having an opening, a vibro-acoustic treatment can be applied on the inner surfaces of the motor housing.

However, acoustic wave energy blocked, i.e., trapped, by the vibro-acoustic treatment will leak out any gaps in the treatment, e.g., through an opening in the housing where the treatment is not applied. Thus there is a need for a structure which can reduce the amount of acoustic wave energy escaping via the opening.

SUMMARY OF THE INVENTION

The present invention is directed to an improved engine having means for controlling and reducing the noise escaping the motor housing via an opening. This is accomplished by installing at least one acoustic seal that extends across a substantial portion of the opening. In accordance with the preferred embodiment, each seal comprises an attachment portion which is adhered to the housing wall adjacent the opening and a flexible, yet self-supporting, membrane made of material which substantially blocks the transmission of acoustic wave energy therethrough. The membrane preferably comprises rubber.

In accordance with the most preferred embodiment, the acoustic seals are used in conjunction with a shroud applied to the inner surface of the housing. The shroud comprises a blanket of material that both damps vibrations and blocks/absorbs acoustic wave energy. Such material will be hereinafter referred to as a "vibro-acoustic treatment". The presence of an opening in the motor housing produces a gap in the noise-suppressing shroud, which gap is partly filled by acoustic seals in accordance with the preferred embodiment. The vibro-acoustic treatment comprises an acoustic barrier laminated to an open-cell foam core that absorbs acoustic energy. In accordance with the preferred embodiment, the motor housing comprises upper and lower motor covers, the opening for the steering arm being formed in the lower motor cover. Respective vibro-acoustic treatments are applied to the upper and lower motor covers. The vibro-acoustic treatment inside the upper motor cover is designed to shift acoustic energy in the frequencies between 1000 and 3000 Hz to frequencies below 1000 Hz and above 3000 Hz. In contrast, the lower motor cover can be considered the primary receiver of the structure-borne noise and vibration. To best attenuate this energy, the vibro-acoustic treatment for the lower motor cover is designed to attenuate across a wide frequency range (e.g., 0 to 4,000 hertz), but was optimized for the frequencies under 1000 Hz. The vibro-acoustic treatment on the upper motor cover was not designed to attenuate frequencies below 1,000 hertz because to do so would require additional mass inside the upper motor cover, which additional mass would negatively impact overall engine performance, e.g., by interfering with the intake of air.

Although the preferred embodiment is disclosed in the context of an outboard marine engine, persons skilled in the art will readily appreciate that the means for noise suppression could also be installed inside a housing encasing the powerhead of an inboard marine engine or any other type of engine. (The terms "powerhead" and "motor" will be used interchangeably throughout the written description and the claims.)

DETAILED DESCRIPTION OF THE PREFERRED EMBODIMENTS

Figure 1:
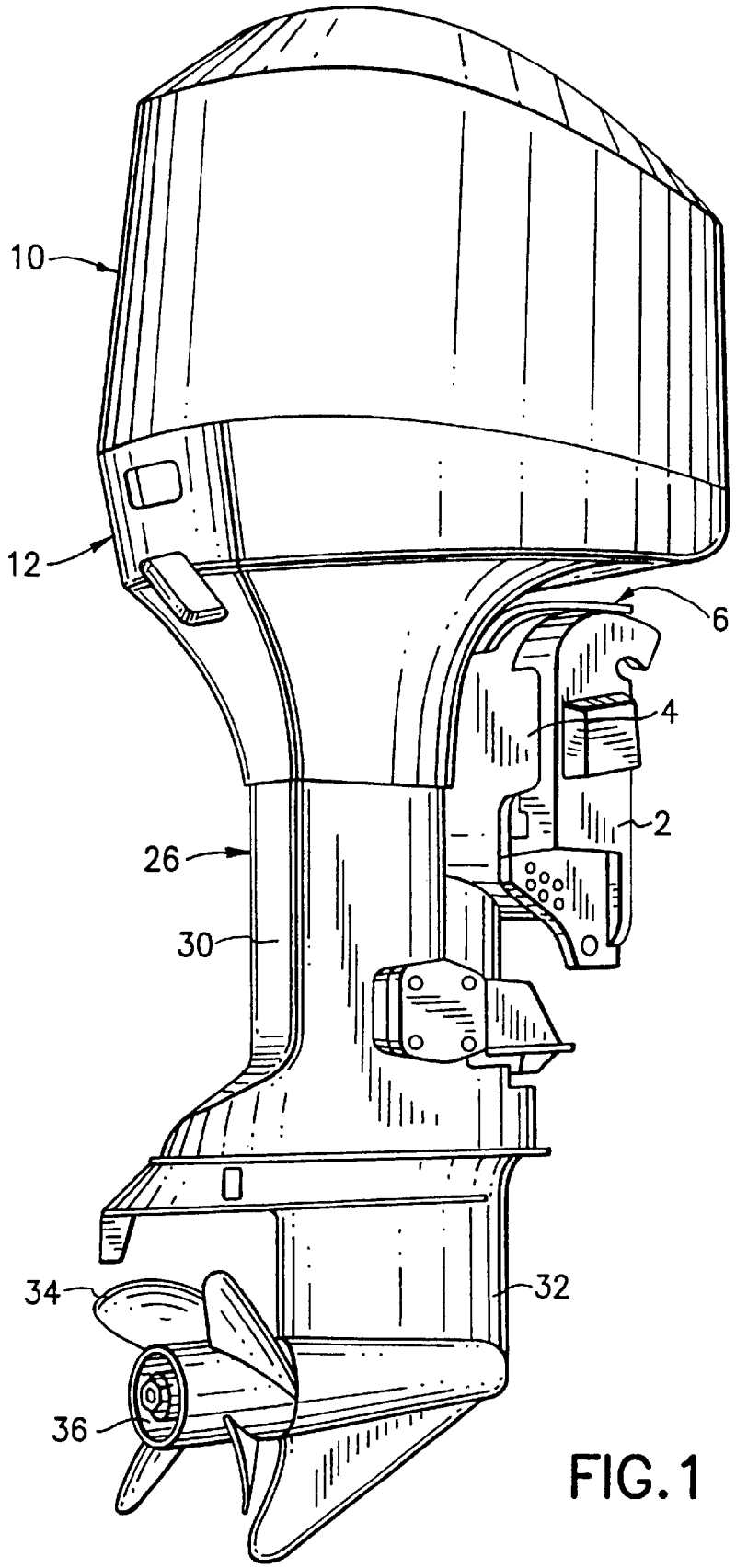
FIG. 1 is a schematic showing a typical outboard marine engine to which the present invention can be applied.

An outboard propulsion unit and means for mounting that propulsion unit to the stern of a boat are shown in FIG. 1. The mounting means comprise a pair of stern brackets 2 (only one of which is visible in FIG. 1) designed to be mounted to the boat stern. A swivel bracket 4, which supports the propulsion unit, is pivotably mounted to the stern brackets 2. The swivel bracket 4 allows the propulsion unit to be tilted about a horizontal axis. The swivel bracket 4 rotatably supports a steering arm assembly 6 (only part of which is visible in FIG. 1) which is rigidly connected to the propulsion unit, to allow the propulsion unit to be turned about the axis of the steering arm assembly 6 for steering the boat.

Figure 2:
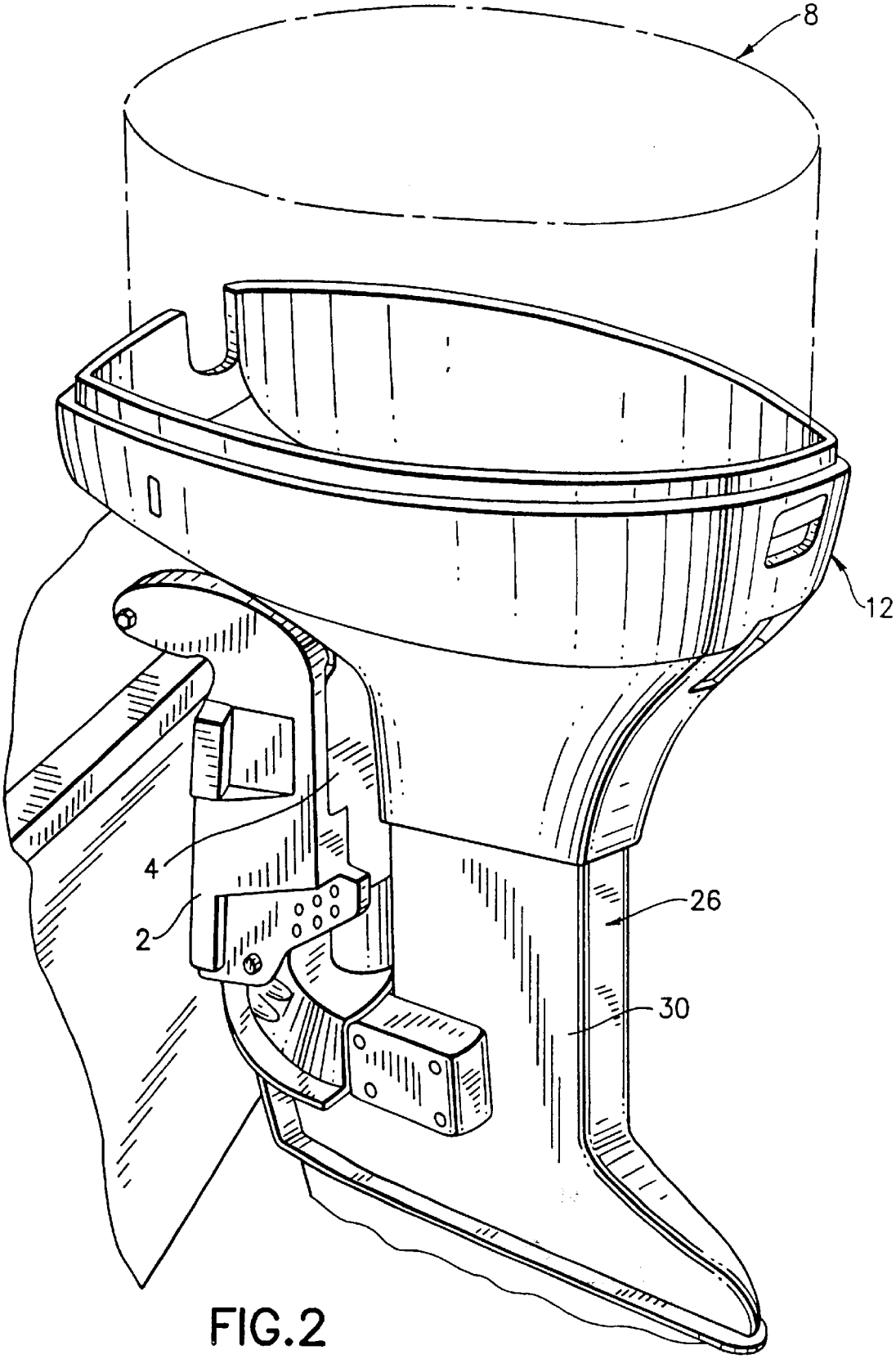
FIG. 2 is a schematic showing the outboard marine engine of FIG. 1 with the upper motor cover removed to reveal the powerhead (in general outline).
Figure 4:
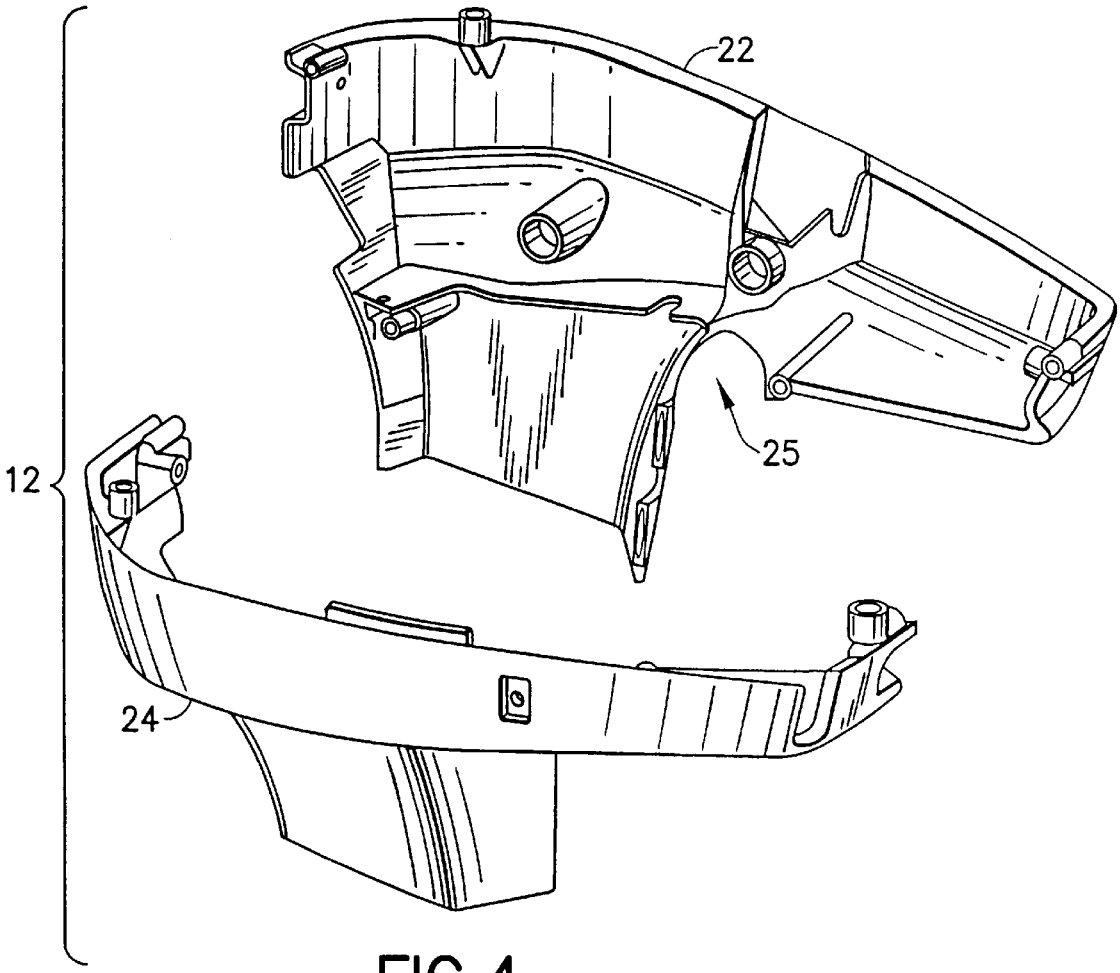
FIG. 4 is a schematic showing port and starboard lower covers for the outboard marine engine shown in FIGS. 1 and 2.
Figure 6:
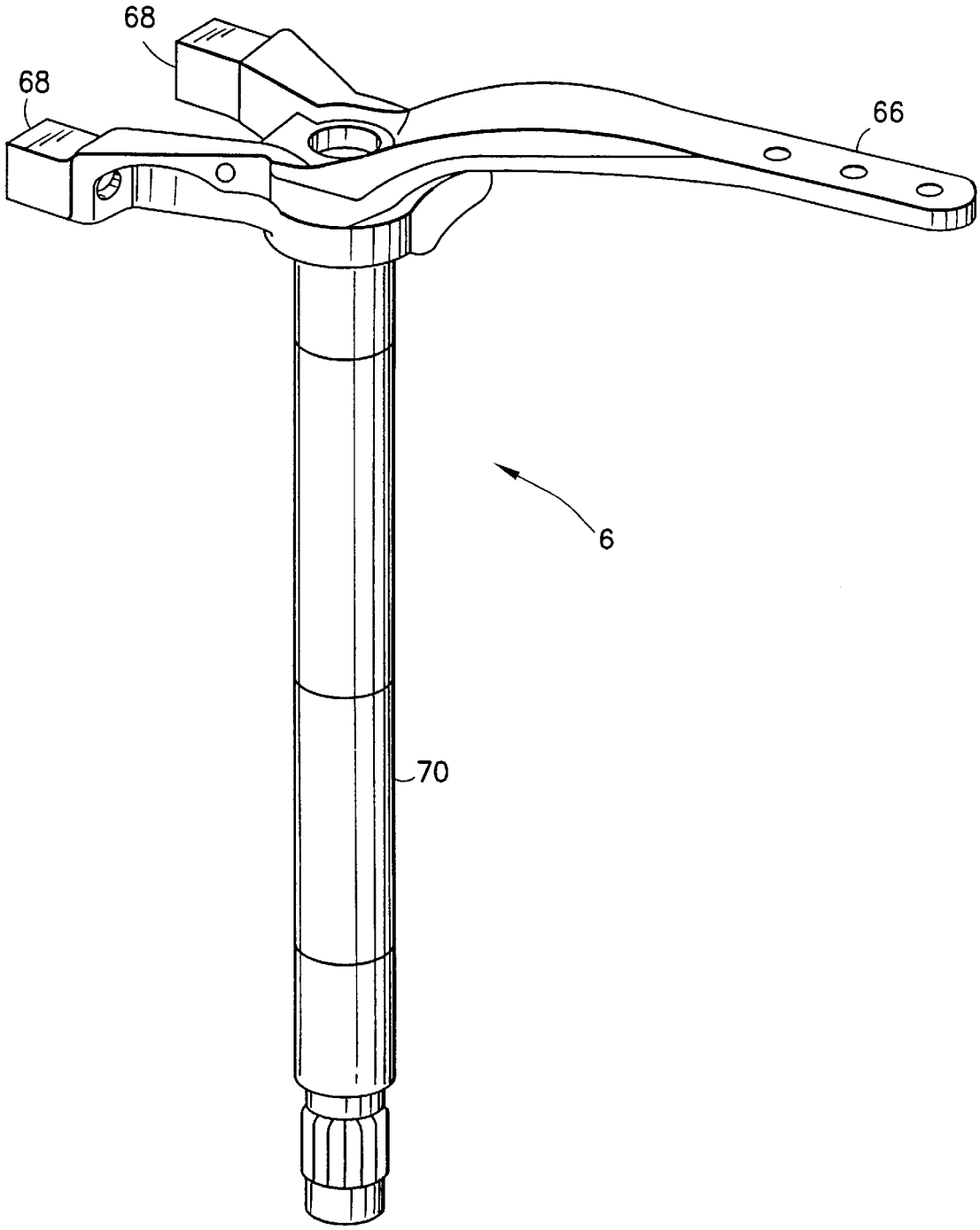
FIG. 6 is a schematic showing the steering arm assembly incorporated in the outboard marine engine shown in FIGS. 1 and 2.
Figure 10:
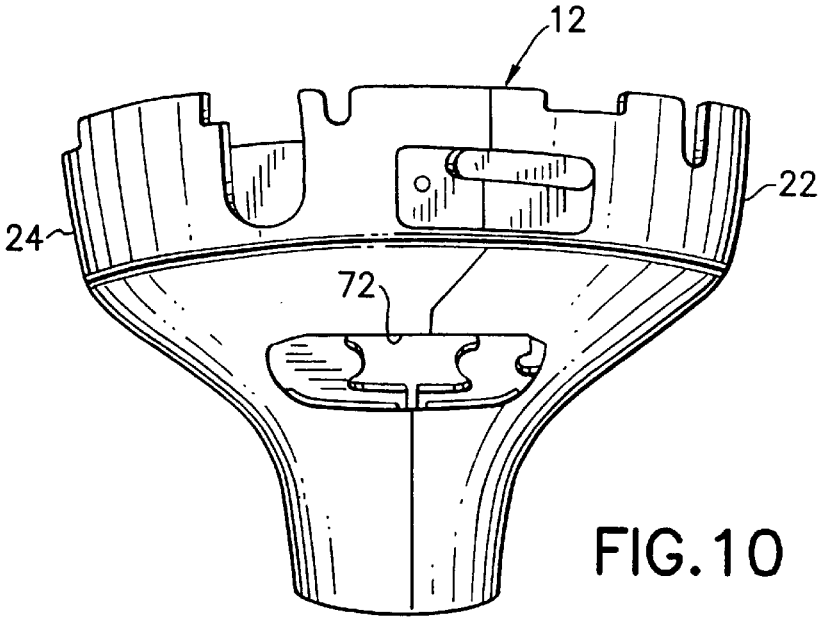
FIG. 10 is a schematic showing a front view of a lower motor cover with the seals of FIGS. 7 and 9 installed in the opening for the steering arm penetration.

The propulsion unit comprises a powerhead 8 (generally outlined in FIG. 2) housed in a casing formed by an upper motor cover 10 and a lower motor cover assembly 12. The upper motor cover 10 and lower motor cover assembly 12 form a housing having an internal volume and an opening 72 which allows the internal volume to communicate with an external volume of ambient air external to the housing. The upper motor cover is preferably made of acetyl butyl styrene, while the lower motor cover is preferably made of fiberglass. As shown in FIG. 4, the lower motor cover assembly 12 comprises a port lower motor cover part 22 and a starboard lower motor cover part 24 which are bolted together. Each lower motor cover part has a U-shaped recess 25 which meet to form the opening 72 (seen in FIG. 10) that allows the finger 68 of the steering arm 66 of assembly 6 (shown in FIG. 6) to penetrate the lower supports the powerhead. The shaft 70 of steering arm assembly 6 is pivotably supported by the swivel bracket 4 (partly shown in FIGS. 1 and 2) to allow turning of the outboard engine in response to steering by the boat operator.

Referring again to FIG. 1, the weight of the powerhead 8 is supported by an exhaust housing assembly 26, which is in turn mounted to the swivel bracket 4 in a known manner. Exhaust from the powerhead flows downward through a passageway in the exhaust housing assembly. A gear case 32 is attached to the bottom of the exhaust housing assembly 26. The gear case houses the lowermost part of the vertical drive shaft (not shown) which is coupled to the powerhead, the propeller shaft (not shown) and the gears (not shown) for converting rotation of the drive shaft into rotation of the propeller shaft. A propeller 34 is mounted on the end of the propeller shaft in conventional manner. The exhaust gases flow through the inner exhaust housing and are exhausted below the waterline through an outlet in the propeller hub 36.

Figure 3:
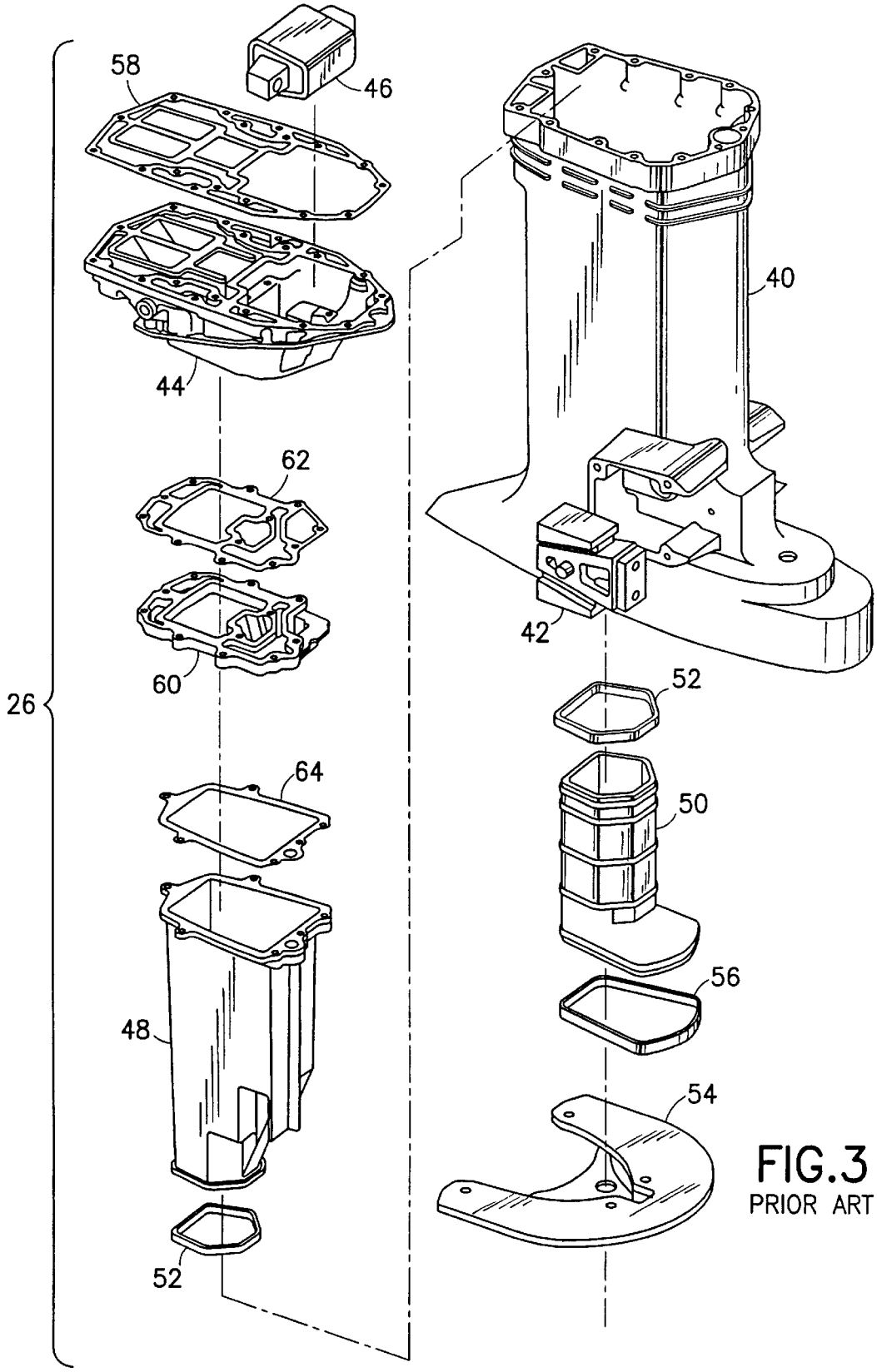
FIG.3 PRIOR ART
FIG. 3 is a schematic showing an exploded view of a known exhaust housing assembly.

The components of a known exhaust housing assembly 26 are shown in the exploded view of FIG. 3. The assembly comprises an outer exhaust housing 40 which is attached to the swivel bracket (item 4 in FIGS. 1 and 2) via a pair of lower rubber mounts 42 (only one of which is shown in FIG. 3). The outer exhaust housing 40 supports the powerhead via an exhaust housing adapter 44, on which the powerhead sits. The steering arm assembly (item 6 in FIG. 1) is coupled to an upper rubber mount assembly 46, which is installed within a recess in the exhaust housing adapter 44.

The exhaust housing assembly 26 further comprises an inner exhaust housing which is supported inside the outer exhaust housing. The inner exhaust housing has an inlet at the top, which is in flow communication with the exhaust port of the powerhead, and an outlet at the bottom that is in flow communication with the hollow propeller hub. The inner exhaust housing comprises an upper inner exhaust housing 48 and a lower inner exhaust housing 50. The outlet at the bottom of the upper inner exhaust housing 48 is connected to the inlet at the top of the lower inner exhaust housing 50, the interface being sealed by a pair of exhaust housing seals 52. Other components shown in FIG. 3 are as follows: item 54 is a spray deflector; item 56 is a seal placed between the gear case and the lower inner exhaust housing 50; item 58 is a gasket placed between the adapter 44 and the powerhead; item 60 is a water plate which directs water and exhaust into the exhaust section; item 62 is a gasket placed between the adapter 44 and the water plate 60; and item 64 is a gasket placed between the upper inner exhaust housing 48 and the water plate 60. The adapter 44, the outer exhaust housing 40 and the inner exhaust housing 48, 50 are preferably made of aluminum.

Figure 5:
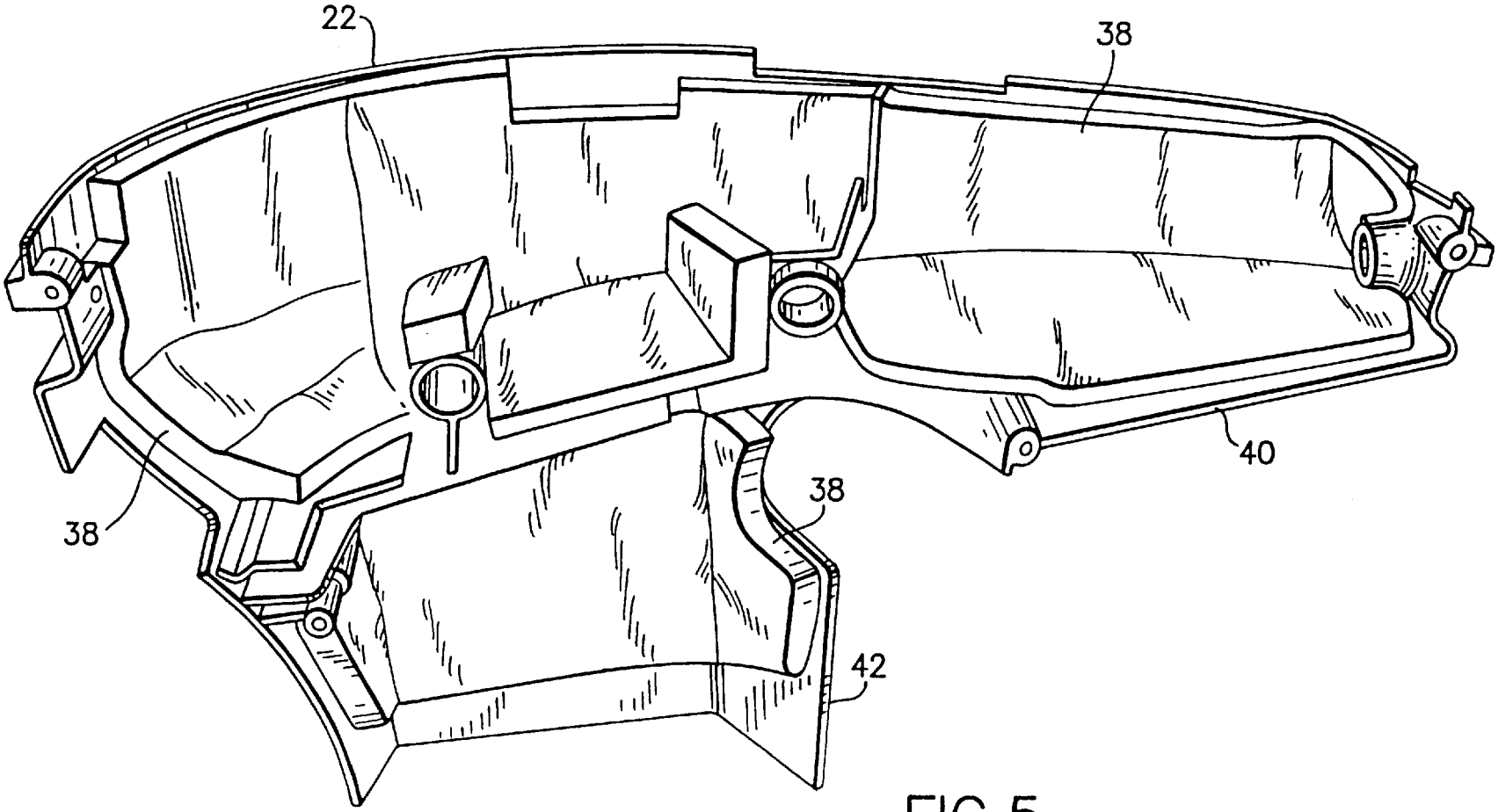
FIG. 5 is a schematic showing the port lower cover having a vibro-acoustic treatment in accordance with a preferred embodiment of the invention.

In accordance with the one preferred embodiment of the invention, the inner surfaces of the port lower motor cover part 22 are blanketed with a vibro-acoustic treatment 38, as shown in FIG. 5, and the inner surfaces of the starboard lower motor cover part are blanketed with a similar vibro-acoustic treatment (not shown). In addition, the inner surfaces of the upper motor cover are also blanketed with a vibro-acoustic treatment. These vibro-acoustic treatments form a shroud that suppresses noise produced by the engine. As seen in FIG. 5, each of the port and starboard lower motor cover parts 22 and 24 comprises an upper portion 40 having inner surfaces which confront the powerhead and a lower portion 42 having inner surfaces which confront the uppermost portion of the exhaust housing assembly 26. In accordance with the preferred embodiment, the inner surfaces of both the upper and lower portions of the port and starboard lower motor cover parts are treated with a composite material that damps mechanical vibrations and blocks/absorbs acoustic wave energy.

The vibro-acoustic composite material in accordance with the preferred embodiment comprises a sheet of moldable acoustic barrier-like material adhered to an inner surface of a motor cover or motor cover part by means of a layer of visco-elastic pressure-sensitive adhesive material. Preferably the acoustic barrier material is free of plasticizers, which tend to migrate into the adhesive layer, causing softening and a decrease in peel strength. The composite material further comprises an acoustical grade, open-cell flexible foam core laminated to the sheet of acoustic barrier material. Optionally, a film facing is fused to the open-cell foam core. The preferred materials for the acoustic barrier and the adhesive are ethylene vinyl acetate and copolymer acrylic adhesive, respectively. The preferred material for both the open-cell foam core and the film facing is polyether-based polyurethane. However, functionally equivalent materials can be used in place of the specific materials disclosed herein.

In the case of a known 250-hp engine treated with vibro-acoustic composite material on both the upper and lower motor covers, the respective vibro-acoustic treatments were different. In the case of the lower motor cover, the sheet of ethylene vinyl acetate had a density of 2 $lb/ft^2$; the acrylic adhesive layer had a thickness of 4 mils; the open-cell polyurethane foam core had a thickness of 0.5 inch; and the film facing had a thickness of 0.005 inch. In the case of the upper motor cover, the sheet of ethylene vinyl acetate had a density of 1 $lb/ft^2$; the acrylic adhesive layer had a thickness of 4 mils; the open-cell polyurethane foam core had a thickness of 0.25 inch; and the film facing had a thickness of 0.005 inch.

The acoustic barrier adhered to the lower motor cover is designed to block transmission of a substantial portion of impinging acoustic wave energy in a range from 0 to 3,000 hertz, whereas the acoustic barrier adhered to the upper motor cover is designed to block transmission of a substantial portion of impinging acoustic wave energy in a range from 1,000 to 3,000 hertz. Preferably, the acoustic barrier material applied to the lower motor cover has a mass per unit area such that a transmission loss of at least 6 dB is attained for transmission of acoustic wave energy over the range from 0 to 3,000 hertz, whereas the acoustic barrier material applied to the upper motor cover as a mass per unit area such that a transmission loss of at least 6 dB is attained for transmission of acoustic wave energy over the range from 1,000 to 3,000 hertz. More specifically, the acoustic barrier for the lower motor cover preferably has a greater mass per unit area than that of the upper motor cover material for blocking the lowest frequencies, i.e., less than 1,000 hertz. Acoustic barrier materials are well known and commercially available.

In accordance with a further aspect of the preferred embodiment, the layers of adhesive material on the inner surfaces of the upper and lower motor covers each have a thickness such that impinging acoustic wave energy in a range of 1,000 to 3,000 hertz is efficiently converted into heat energy. In particular, each layer of adhesive material should have a thickness such that impinging acoustic wave energy is converted into heat energy to achieve an overall reduction of at least 3 dBa for the ⅓ octave band levels in a range from 0 to 4,000 hertz.

In addition, each vibro-acoustic treatment comprises an open-cell foam core laminated to the side of the acoustic barrier material opposite the adhesive. This open-cell foam core should have an average pore size that is optimized to attenuate, i.e., absorb, acoustic wave energy in a range of 1,000 to 3,000 hertz.

Figure 11:
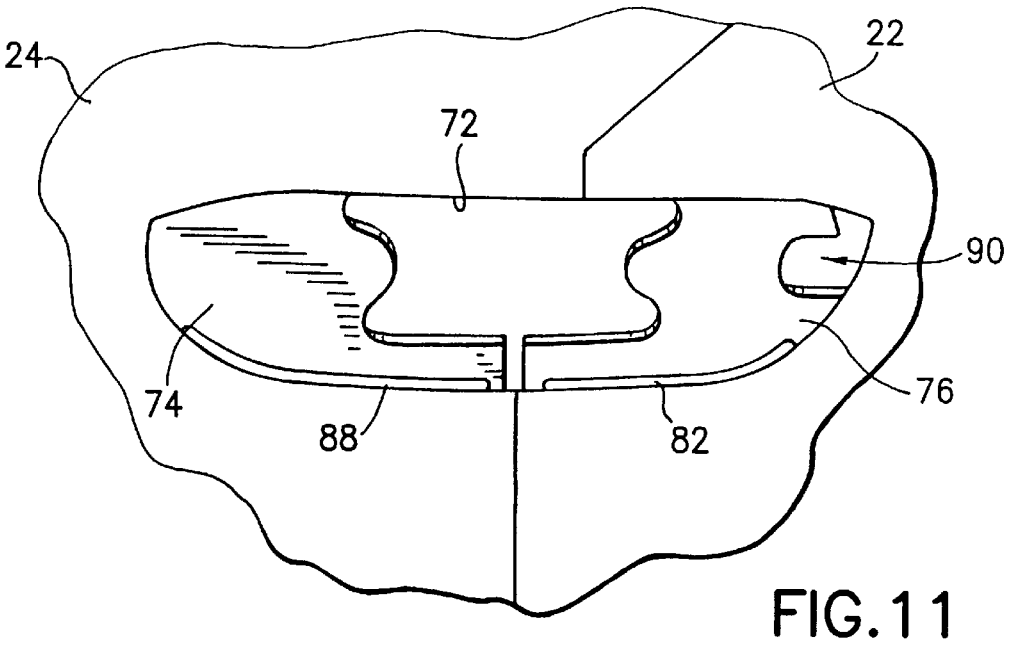
FIG. 11 is a schematic showing the sealed opening of FIG. 10 in a magnified view.

In accordance with the preferred embodiment of the present invention, a powerhead of an outboard marine engine is shrouded to damp vibrations and suppress noise. Preferably the vibro-acoustic treatment disclosed herein is used in combination with a pair of acoustic seals 74 and 76 (see FIGS. 10 and 11) placed across respective portions of the opening 72 in the lower motor cover 12. These acoustic seals reduce the amount of acoustic wave energy leaking out through the opening 72. Preferably, the acoustic seals are made of a material which is flexible, yet self-supporting, and which substantially blocks transmission therethrough of acoustic wave energy in the range from 0 to 3,000 hertz. The preferred material is epichlorohydrin rubber. Epichlorohydrin rubber is widely used as a rubber material that satisfies strict environmental regulations and high performance requirements in the automobile industry. Its high resistance to heat and oil makes it ideal as a material for use as an acoustic seal for a motor housing of an outboard marine engine. The opposing edges of the acoustic seals 74 and 76 preferably have cutouts shaped to provide clearance for the steering arm. In addition, the port acoustic seal 76 has a further cutout 90 to provide clearance for an electrical cable that penetrates the opening 72.

Figure 7:
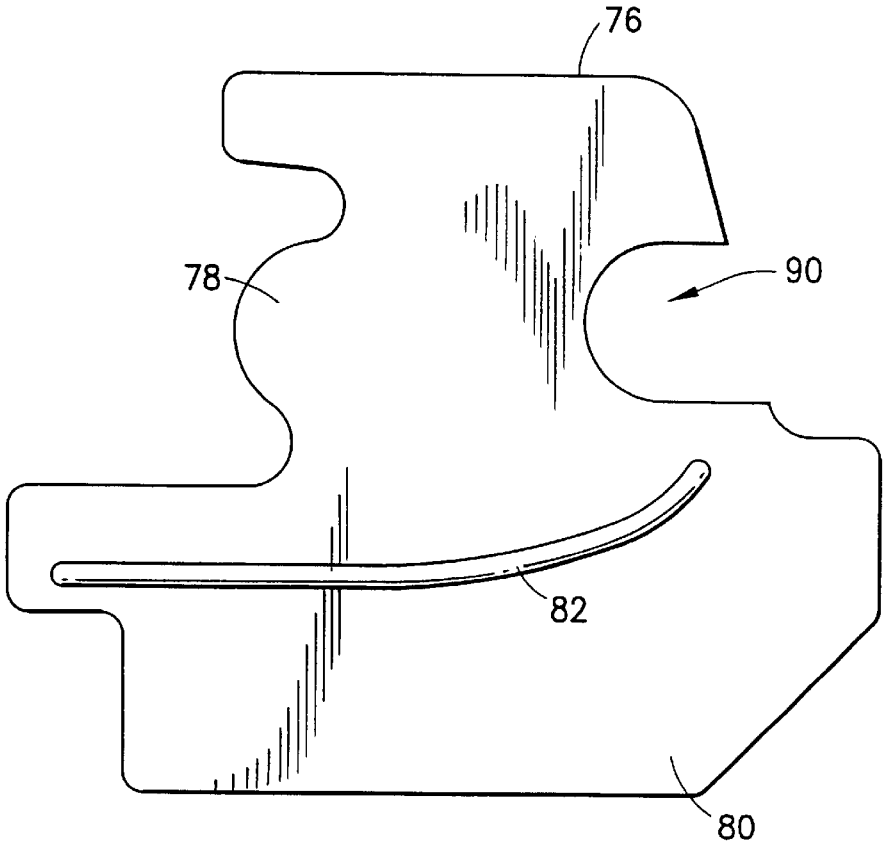
FIGS. 7 and 8 are schematics showing front and side views of a port steering arm seal in accordance with the preferred embodiment of the invention.
Figure 8:
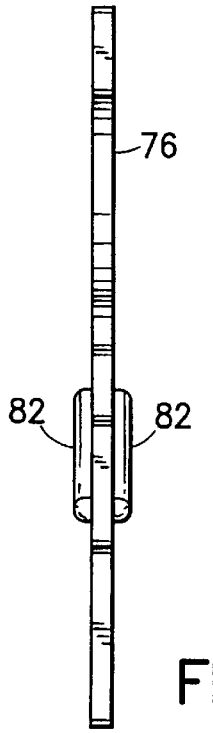

The port acoustic seal 76 is shown in detail in in FIG. 7. The port acoustic seal preferably comprises a barrier membrane 78 which blocks acoustic wave energy across a first portion of the opening and an attachment membrane 80 which is secured by adhesive (e.g., glue) to a first peripheral region of the inner surface of the lower motor cover, adjacent the boundary which defines opening 72 (see FIG. 11). Optionally, the port acoustic seal 76 further comprises a stiffening rib 82 which abuts the boundary defining the opening. The contour of rib 82 matches the contour of that portion of the boundary against which rib 82 abuts. As seen in FIG. 8, the port acoustic seal 76 may have ribs on both sides to increase the stiffening effect.

Figure 9:
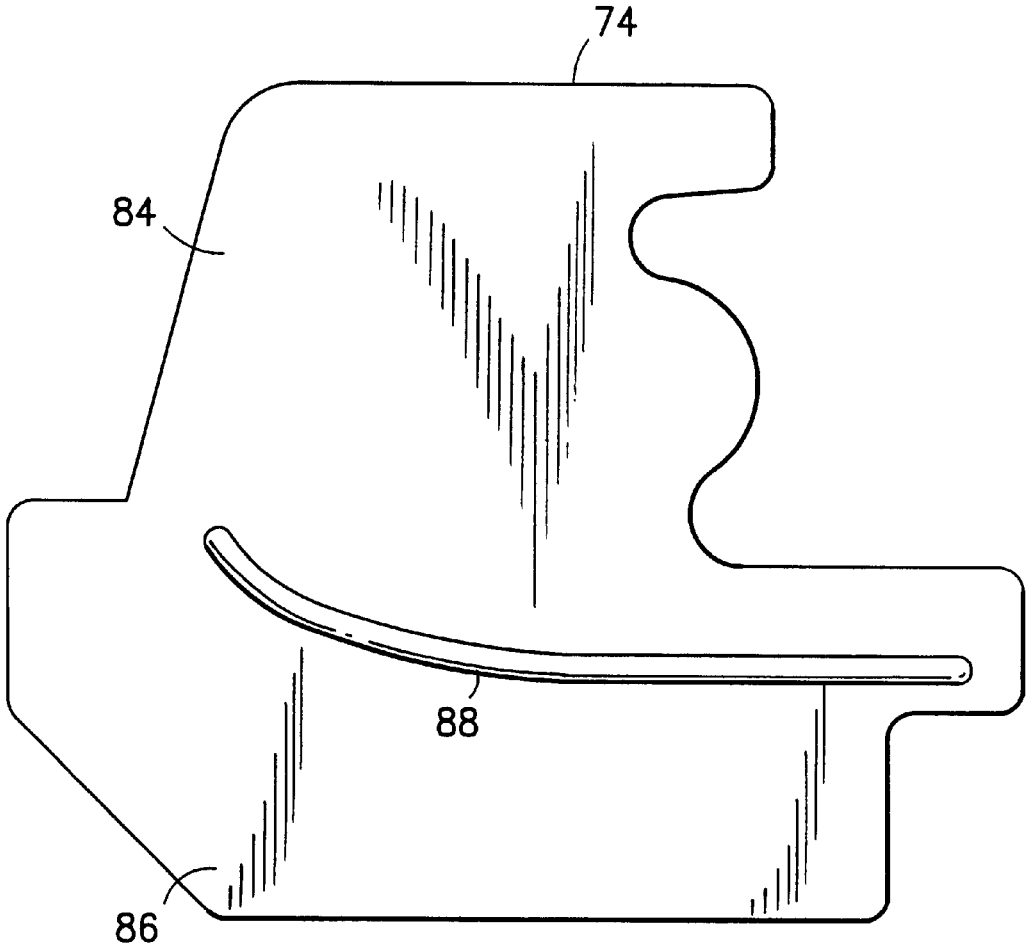
FIG. 9 is a schematic showing a front view of a starboard steering arm seal in accordance with the preferred embodiment of the invention. The side view is the same as that shown in FIG. 8.

The starboard acoustic seal 76 is shown in detail in FIG. 9. The starboard acoustic seal is similar in structure to the port acoustic seal and preferably comprises a barrier membrane 84 which blocks acoustic wave energy across a second portion of the opening and an attachment membrane 86 which is secured by adhesive (e.g., glue) to a second peripheral region of the inner surface of the lower motor cover, adjacent the boundary which defines opening 72. Optionally, the starboard acoustic seal 74 further comprises a stiffening rib 88 that abuts the boundary defining the opening. The contour of rib 88 matches the contour of that portion of the boundary against which rib 88 abuts. The starboard acoustic seal may have ribs on both sides to increase its stiffening effect.

Each barrier membrane of the acoustic seals 74 and 76 must be made of a material which is able to flex when displaced by the steering arm and which is able to stand upright without external support. The latter feature is necessary because the opening 72 does not lie in a plane. As a result, when the acoustic seals are attached to the lower boundary of opening 72, there is a gap between the upper boundary of the opening and the uppermost portion of the barrier membranes. As a result, the uppermost portion of each barrier membrane is supported only by the lower portions of the same barrier membrane, i.e., each barrier membrane is self-supporting. The material making up the barrier membrane should be selected so that it will not wilt or sag over time as the result of exposure to seawater, temperature changes, engine oil, extreme heat, etc. Preferably, the barrier membrane, the attachment membrane and the rib are molded as one piece from the same material, e.g., epichlorohydrin rubber.

While the invention has been described with reference to preferred embodiments, it will be understood by those skilled in the art that various changes may be made and equivalents may be substituted for elements thereof without departing from the scope of the invention. For example, the separate port and starboard acoustic seals could be easily formed as a single monolithic seal having the same overall dimensions and shape. In addition, many modifications may be made to adapt a particular situation to the teachings of the invention without departing from the essential scope thereof. Therefore it is intended that the invention not be limited to the particular embodiment disclosed as the best mode contemplated for carrying out this invention, but that the invention will include all embodiments falling within the scope of the appended claims.

What is claimed is:

1. A propulsion system comprising:

a motor;

a housing encasing said motor and forming an internal volume, said housing comprising an inner surface and an opening which allows said internal volume to communicate with an external volume of ambient air external to said housing; and a first acoustic seal comprising first and second membrane portions, said first membrane portion being attached to a first peripheral region of said housing adjacent said opening, and said second membrane portion being self-supporting except for connection to said first membrane portion, being disposed between said motor and said opening, and being made of a material which is flexible and which substantially blocks transmission therethrough of acoustic wave energy in the range from 0 to 3,000 hertz.

2. The system as recited in claim 1, wherein said material is rubber.

3. The system as recited in claim 1, wherein said first acoustic seal is attached by gluing.

4. The system as recited in claim 1, wherein said first acoustic seal further comprises a rib integrally formed with said second membrane portion.

5. The system as recited in claim 4, wherein said rib has an edge which conforms to and abuts a peripheral portion of said opening.

6. The system as recited in claim 1, further comprising a second acoustic seal comprising third and fourth membrane portions, said third membrane portion being attached to a second peripheral region of said housing adjacent said opening, and said fourth membrane portion being self-supporting except for connection to said third membrane portion, being disposed between said motor and said opening, and being made of a material which is flexible and which substantially blocks transmission therethrough of acoustic wave energy in the range from 0 to 3,000 hertz.

7. The system as recited in claim 6, wherein said membranes of said first and second acoustic seals are made of the same material.

8. The system as recited in claim 6, wherein said membranes of said first and second acoustic seals have opposing cutouts.

9. The system as recited in claim 1, further comprising a motor support structure for supporting said motor arranged inside said housing and a steering arm connected to said motor support structure and penetrating said opening in said housing.

10. The system as recited in claim 1, further comprising means for supporting said system outboard a boat.

11. The system as recited in claim 1, wherein said housing comprises an upper motor cover and a lower motor cover, said opening being formed in said lower motor cover.

12. The system as recited in claim 11, further comprising a first vibro-acoustic treatment covering at least a portion of said inner surface of an upper part of said housing, said first vibro-acoustic treatment being designed to shift acoustic energy in the frequencies between 1000 and 3000 hertz to frequencies below 1000 hertz and above 3000 hertz; and a second vibro-acoustic treatment covering at least a portion of said inner surface of a lower part of said housing, said second vibro-acoustic treatment being optimized to attenuate acoustic energy in the frequencies below 1000 hertz, wherein each of said vibro-acoustic treatments comprises a sheet of acoustic barrier material and a layer of adhesive material for adhering said sheet of acoustic barrier material to said inner surface of a respective one of said upper and lower parts of said housing.

13. The system as recited in claim 1, further comprising a vibro-acoustic treatment covering at least a portion of said inner surface of said housing, wherein said vibro-acoustic treatment comprises a sheet of acoustic barrier material and a layer of adhesive material for adhering said sheet of acoustic barrier material to said inner surface of said housing.

14. An outboard engine comprising:

a motor;

a housing encasing said motor and forming an internal volume, said housing comprising an inner surface and an opening which allows said internal volume to communicate with an external volume of ambient air external to said housing;

a first acoustic barrier covering a substantial portion of said inner surface of said housing, said first acoustic barrier being adhered to said portion of said inner surface of said housing; and a second acoustic barrier comprising first and second membrane portions, said first membrane portion being attached to a first peripheral region of said housing adjacent said opening, and said second membrane portion being self-supporting except for connection to said first membrane portion, being disposed between said motor and said opening, and being made of a material which is flexible, wherein said first and second acoustic barriers substantially block transmission therethrough of acoustic wave energy in a range from 1,000 to 3,000 hertz.

15. The outboard engine as recited in claim 14, wherein said material is rubber.

16. The outboard engine as recited in claim 14, wherein said second acoustic barrier further comprises third and fourth membrane portions, said third membrane portion being attached to a second peripheral region of said housing adjacent said opening, and said fourth membrane portion being self-supporting except for connection to said third membrane portion, being disposed between said motor and said opening, and being made of a material which is flexible.

17. The outboard engine as recited in claim 14, further comprising a motor support structure for supporting said motor arranged inside said housing and a steering arm connected to said motor support structure and penetrating said opening in said housing.

18. The outboard engine as recited in claim 14, wherein said housing comprises an upper motor cover and a lower motor cover, said opening being formed in said lower motor cover.

19. The outboard engine as recited in claim 14, wherein said first acoustic barrier has a mass per unit area such that a transmission loss of at least 6 dB is attained for transmission of acoustic wave energy in a range of 1,000 to 3,000 hertz.

20. The outboard engine as recited in claim 14, further comprising an open-cell foam core laminated to said first acoustic barrier.

21. An outboard engine comprising:

a motor;

a housing encasing said motor and having an inner surface and a boundary defining an opening;

a motor support structure for supporting said motor arranged inside said housing;

a steering arm having an end connected to said motor support structure and an intermediate portion penetrating said opening in said housing; and acoustic sealing means attached to a portion of said boundary and extending across a substantial portion of said opening, said acoustic sealing means having a cutout providing clearance for said steering arm, wherein said acoustic sealing means comprise first and second membranes extending across respective portions of said opening on opposite sides of said steering arm, each of said membranes comprising an attachment portion attached to a respective portion of said boundary and a self-supporting portion supported only by said respective first membrane portion, each of said self-supporting portions being disposed between said motor and said opening and being made of flexible material.

22. The outboard engine as recited in claim 21, wherein said first and second membranes comprise rubber.

23. The outboard engine as recited in claim 21, further comprising a vibro-acoustic treatment covering at least a portion of said inner surface of said housing, wherein said vibro-acoustic treatment comprises a sheet of acoustic barrier material and a layer of adhesive material for adhering said sheet of acoustic barrier material to said inner surface of said housing.

24. A method for suppressing noise from a powerhead mounted inside a housing having an inner surface and a boundary defining an opening, comprising the step of adhering one side of an attachment portion of an acoustic seal against a peripheral region of said housing which is adjacent to a first portion of said boundary, with a barrier portion of said acoustic seal extending across a substantial portion of said opening, said barrier portion of said acoustic seal being self-supporting except for connection to said attachment portion and being made of a flexible material having the property of substantially blocking transmission therethrough of acoustic wave energy.

25. The method as recited in claim 24, further comprising the step of adhering a sheet of acoustic barrier material to a substantial portion of said inner surface of said housing, wherein said acoustic barrier material has a mass per unit area such that a transmission loss of at least 6 dB is attained for transmission of acoustic wave energy in a range of 1,000 to 3,000 hertz.

26. The method as recited in claim 25, further comprising the step of laminating an open-cell foam core to said sheet of acoustic barrier material.

* * * * *